US007520121B2

(12) United States Patent
Teshima et al.

(10) Patent No.: US 7,520,121 B2
(45) Date of Patent: Apr. 21, 2009

(54) COMPOSITE TWISTED YARN

(75) Inventors: Koichi Teshima, Osaka (JP); Masami Asano, Anpachi-gun (JP)

(73) Assignees: Kuraray Trading Co., Ltd., Osaka-shi (JP); Asano Nenshi Co., Ltd., Anpachi-gun (JP)

( * ) Notice: Subject to any disclaimer, the term of this patent is extended or adjusted under 35 U.S.C. 154(b) by 0 days.

(21) Appl. No.: 10/592,796

(22) PCT Filed: Mar. 14, 2005

(86) PCT No.: PCT/JP2005/004450

§ 371 (c)(1),
(2), (4) Date: Sep. 14, 2006

(87) PCT Pub. No.: WO2005/087995

PCT Pub. Date: Sep. 22, 2005

(65) Prior Publication Data

US 2007/0214765 A1 Sep. 20, 2007

(30) Foreign Application Priority Data

Mar. 15, 2004 (JP) ..... 2004-072663
Nov. 22, 2004 (JP) ..... 2004-338000

(51) Int. Cl.
*D02G 3/02* (2006.01)
*D02G 3/22* (2006.01)

(52) U.S. Cl. ..... 57/236; 57/238

(58) Field of Classification Search ..... 57/236, 57/238

See application file for complete search history.

(56) References Cited

U.S. PATENT DOCUMENTS 110,012 A * 12/1870 Crocker ..... 139/385
4,466,331 A * 8/1984 Matheson ..... 87/12

FOREIGN PATENT DOCUMENTS

| | | |
|---|---|---|
| EP | 1 061 162 | 12/2000 |
| JP | 54 2440 | 1/1979 |
| JP | 60 119248 | 6/1985 |
| JP | 60 199947 | 10/1985 |
| JP | 10 219538 | 8/1998 |
| JP | 11 241269 | 9/1999 |
| JP | 2001 131838 | 5/2001 |

* cited by examiner

*Primary Examiner*—Shaun R Hurley
(74) *Attorney, Agent, or Firm*—Oblon, Spivak, McClelland, Maier & Neustadt, P.C.

(57) ABSTRACT

A textile includes a composite twisted yarn, including a spun yarn and a water-soluble yarn. The spun yarn has a twist direction that is a reverse of a twist direction of the composite twisted yarn. The water-soluble yarn is twisted with the spun yarn. A twist number of the composite twisted yarn is 1.3 to 3 times a twist number of the spun yarn, and a weight ratio of the spun yarn relative to the water-soluble yarn [spun yarn]/[water-soluble yarn] is 20/80 to 98/2. An other textile may also include an elongated elastic yarn having an elongation of 2 to 5 times an original length of the elastic yarn in a non-elongated position, and the elongated elastic yarn is twisted with the water-soluble yarn and the spun yarn. A twist number of the composite twisted yarn is 0.3 to 3 times a twist number of the spun yarn.

10 Claims, 1 Drawing Sheet

COMPOSITE TWISTED YARN

TECHNICAL FIELD

The present invention relates to a composite twisted yarn (or composite twist yarn) in which a spun yarn and a water-soluble yarn at least are twisted, and a process for producing the composite twisted yarn, as well as a textile (a woven or knitted cloth) or fabric formed from the composite twisted yarn, and a process for producing the textile or fabric.

BACKGROUND ART

A variety of ideas and devices have been worked out for imparting a stretching property (elasticity) to a textile woven from a spun yarn. For example, a textile which is produced from a composite yarn made of a spun yarn in combination with a polyurethane elastic yarn has a stretching property, and is excellent in a fitting (or clinging) property to the human body as well as a following property to the human motion. Such a textile is comfortable to wear and does not restrict the human motion (or movement) Accordingly, the textile is widely used in clothing applications such as sportswear, underwear (or inner wear) and foundation garments. Moreover, by making use of the stretching property, such a textile is also used in medical applications such as an elastic band age, an industrial material (application) such as a vehicle interior material or a cloth for a belt conveyor, and others.

Typical examples of the composite yarn made of the spun yarn in combination with the polyurethane elastic yarn may include (1) a core spun yarn in which a polyurethane elastic core yarn covered with stable fiber is twisted; (2) a single or double covered yarn in which a single- or double-layered spun yarn is entwined around a core yarn made of a polyurethane elastic yarn; (3) a ply yarn (plied yarn) in which not less than two spun yarns and a polyurethane elastic yarn are twisted together; and others.

Among these composite yarns, the core spun yarn (1) has the same feel as a single spun yarn because the polyurethane elastic yarn is completely covered with the staple fiber. However, in the spinning step of the staple fiber, highly advanced technologies are required to cover the polyurethane elastic yarn with the staple fiber completely, as well as in the knotting by an air splicer used in the spinning step. Therefore, the core spun yarn (1) is difficult to manufacture. In addition, since a large amount of the staple fiber is used in order to cover the polyurethane elastic yarn completely, a finally obtained core spun yarn tends to be thickened. Therefore, it is extremely difficult to produce a core spun yarn of a fine count. Further, it is necessary to sort a raw stock to be used as the staple fiber, and in addition, highly advanced technology is required as described above. Accordingly, the core spun yarn (1) is practically inadequate for small lot productions. Furthermore, although cotton is mainly used as the staple fiber for making a core spun yarn at present, a stable industrial technology has not been established for producing a core spun yarn by using a fiber other than the cotton (for example, other natural fiber such as a hemp or a silk, and a synthetic fiber) as the staple fiber. Additionally, since the core spun yarn is produced by twisting a polyurethane elastic yarn entwined with unspun staple fiber, the yarn strength or stretching property of the core spun yarn itself is not very high. Therefore, the tension or stretching property of a textile made of the core spun yarn is also insufficient. Moreover, since such a core spun yarn is liable to cause fluff on a surface thereof, it is essential to subject the core yarn to a sizing treatment in a process for knitting or weaving the yarn, and in addition, the productivity of the textile tends to be decreased in the knitting or weaving process.

In the covered yarn (2), since a filiform spun yarn is wound around the polyurethane elastic yarn, the covered yarn (2) has excellent yarn strength and good external appearance or touch. Further, a yarn having a desired count ranging from a low count to a fine count is producible. However, since it is necessary to wind the spun yarn around the polyurethane elastic yarn until the polyurethane elastic yarn is completely covered with the spun yarn, the productivity of the covered yarn (2) is low. In addition, the weight of a textile obtained from the covered yarn tends to be increased.

The ply yarn (3) is usually produced by twisting a plurality of spun yarns and a polyurethane elastic yarn after drawing (bundling and drawing) these yarns in parallel to one another (doubling). Therefore, sorting of the raw stock, which is required for the core spun yarn (1) is unnecessary. Accordingly, the ply yarn (3) has a high productivity, and is also applicable to the manufacture of a wide variety of products in small quantities. However, some problems with the manufacturing thereof are prone to occur. For example, the polyurethane elastic yarn can protrude outside two or more spun yarns due to incomplete inclusion of the polyurethane elastic yarn between the spun yarns, or the polyurethane elastic yarn can be cut in the production process of the ply yarn. Furthermore, since two or more spun yarns are used, the production of a fine count ply yarn requires an expensive fine count spun yarn having a yarn fineness of not more than a half of that of an objective ply yarn. Therefore, the production of the ply yarn (particularly, a fine count ply yarn) is not only difficult but also economically disadvantageous.

Japanese Patent Application Laid-Open No. 131838/2001 (JP-2001-131838A, Patent Document 1) discloses a composite twisted yarn in which a single spun yarn and at least one continuous fiber(s) are twisted, wherein the twist direction of the composite twisted yarn and that of the spun yarn is the same, and the twist number of the composite twisted yarn is larger than that of the spun yarn. However, even in the composite yarn, the torque of the twist yarn cannot be reduced, and in addition, the yarn has insufficient yarn strength or stretching property, and feel.

On the other hand, a method for improving a stretching property of a textile made of a spun yarn without a polyurethane elastic yarn is also under investigation. Due to a high stretching property of the polyurethane elastic yarn, a special apparatus and technique are required for handling, or knitting or weaving a composite yarn comprising the polyurethane elastic yarn. Moreover, since the polyurethane elastic yarn is liable to generate degradation with time passage due to heat, light, etc., a composite yarn comprising the polyurethane elastic yarn as well as a textile comprising the polyurethane elastic yarn gradually lose their stretching property. Further, a textile made of a composite yarn containing the polyurethane elastic yarn easily deteriorates in flexibility, soft feel, lightness in weight, and others.

Then, for example, Japanese Patent Application Laid-Open No. 241269/1999 (JP-11-241269A, Patent Document 2) discloses a process for producing a stretchy wool fabric, which comprises providing a fabric made of a mixing (blending) spun yarn comprising a wool fiber and a water-soluble polyvinyl alcohol fiber; soaking (immersing) the fabric in a water bath and raising a temperature of the water bath from an ambient temperature so as to contract the water-soluble polyvinyl alcohol fiber; dissolving and removing the water-soluble polyvinyl alcohol fiber to produce a fabric comprising only the wool fiber; and set-treating the fabric. In this process, however, the mixing spun yarn is low in yarn strength, and in the case of weaving or knitting the yarn with a high-speed weaving machine or knitting machine, difficulties such as thread breakage easily occur. Further, thus obtained wool fabric also has low mechanical properties such as a stretching property or strength. Furthermore, in this process, it is difficult to obtain a stretchy fabric in the case of using a fiber (such as cotton or a synthetic fiber) other than sheep wool.

Moreover, EP Patent No. 1061162B1 (Patent Document 3) discloses a process for manufacturing a fabric made of 100% pure cashmere, which comprises preparing a composite yarn by mixing (or blending) a cashmere yarn with a second yarn that is dissolvable in a slightly acidic aqueous solution at a high temperature; weaving or knitting the obtained composite yarn to make a textile; and dissolving the second yarn in acid to remove it from the textile. However, the fabric of pure cashmere obtained by this process also has an insufficient stretching property. In addition, due to removal of the second yarn with an acid, the residual yarn tends to be deteriorated or have other problems.

[Patent Document 1] JP-2001-131838A (Claim 1, Paragraph No. [0027])

[Patent Document 2] JP-11-241269A (Claim 1)

[Patent Document 3] EP Patent No. 1061162B1 (Claim 1)

DISCLOSURE OF THE INVENTION

Problems to be Solved by the Invention

It is an object of the present invention to provide a highly stretchy composite twisted yarn having a high yarn strength, and producing a textile (fabric) from the yarn having a high stretching property without causing problems such as a thread breakage even in weaving or knitting with a high-speed weaving or knitting machine; and a production process thereof; as well as a textile (a woven or knitted material) or fabric obtained by using the composite twisted yarn.

It is another object of the present invention to provide a highly stretchy composite twisted yarn having minimal fluff (or fuzz) and being capable of feasibly weaved or knitted into a lightweight textile or fabric having good external appearance, touch (flexibility), air permeability, and mechanical properties even in omitting warp sizing (sizing of warp); and a production process thereof; as well as a textile (a woven or knitted material) or fabric obtained from the composite twisted yarn.

It is still another object of the present invention to provide a composite twisted yarn in which sorting a raw stock and others are unnecessary, a variety of spun yarns such as a spun yarn made of a natural fiber, a synthetic fiber, a semisynthetic fiber, or others is usable, and high productivity is achieved even in manufacture of a wide variety of products in small quantities; and a production process thereof; as well as a textile (a woven or knitted material) or fabric obtained by using the composite twisted yarn.

It is a further object of the present invention to provide a composite twisted yarn producible as a fine count yarn which has been difficult to produce in the conventional ply yarns or core spun yarns; and a production process thereof; as well as a textile (a woven or knitted material) or fabric obtained by using the composite twisted yarn.

It is still a further object of the present invention to provide a composite twisted yarn capable of producing a textile (a woven or knitted material) or fabric having a high stretching property even without an elastic yarn such as a polyurethane elastic yarn, and having properties such as being lightweight, having excellent flexibility and feel; and a production process thereof; as well as a textile (a woven or knitted material) or fabric obtained by using the composite twisted yarn.

Means to Solve the Problems

The inventors of the present invention made intensive studies to achieve the above objects and finally found that a composite twisted yarn having a high yarn strength is obtained by, instead of twisting two species of yarns comprising a spun yarn and a polyurethane elastic yarn, (a) using three species of yarns (a spun yarn, a elongated (stretched) elastic yarn, and a water-soluble yarn) in a specific proportion, (b) twisting the three species of yarns in a direction which is reverse to the twist direction of the spun yarn, and (c) making the ratio of the twist number of the three species of yarn (the composite twisted yarn) relative to the twist number of the spun yarn in a specific range; and that a textile (fabric) having a highly stretching (elastic) property is smoothly producible from the strong composite twisted yarn without causing problems such as a thread breakage even in knitting or weaving with a high-speed weaving or knitting machine. The present invention was accomplished based on the above findings. Further, the inventors found that a textile or fabric having a high stretching property and being lightweight, having excellent flexibility, or feel is producible without an elastic yarn such as a polyurethane elastic yarn by using a spun yarn and a water-soluble yarn in a specific proportion, and twisting the spun yarn and the water-soluble yarn in a reverse direction to the twist direction of the spun yarn so as to make the twist ratio of the twist number of the spun yarn relative to the twist number of both yarns into a specific range. The present invention was accomplished based on the above findings.

That is, the composite twisted yarn of the present invention is a composite twisted yarn (composite twist yarn) which at least comprises a spun yarn and a water-soluble yarn which is twisted with the spun yarn, wherein the twist direction of the composite twisted yarn is reverse to the twist direction of the spun yarn, and the composite twisted yarn fulfils (satisfies) the following requirement (condition) (1) or (2):

(1) the twist number (the number of twists) of the composite twisted yarn is 1.3 to 3 times that of (as large as) the twist number of the spun yarn, and the proportion (weight ratio) of the spun yarn relative to the water-soluble yarn [spun yarn]/[water-soluble yarn] is 20/80 to 98/2, (2) the composite twisted yarn further comprises an elongated elastic yarn which has an elongation of 2 to 5 times that of the original length; the spun yarn, the water-soluble yarn, and the elongated elastic yarn are twisted together; the twist number of the composite twisted yarn is 0.3 (three-tenths) to 3 times that of the twist number of the spun yarn; the proportion (weight ratio) of the spun yarn relative to the elastic yarn [spun yarn]/[elastic yarn] is 50/50 to 99.9/0.1; and the proportion (weight ratio) of the total amount of the spun yarn and the elastic yarn relative to the water-soluble yarn [total amount of the spun yarn and the elastic yarn]/[water-soluble yarn] is 30/70 to 99/1.

In the composite twisted yarn fulfilling the requirement (2), the elastic yarn may be, for example, a polyurethane elastic yarn. Further, based on (relative to) the weight of the composite twisted yarn, the proportion of the spun yarn may be about 20 to 98% by weight, the proportion of the elastic yarn may be about 0.5 to 20% by weight, and the proportion of the water-soluble yarn may be about 1 to 70% by weight. The water-soluble yarn may be, for example, a water-soluble filament yarn.

The present invention also encompass a process for producing the above-mentioned composite twisted yarn at least comprising a spun yarn and a water-soluble yarn, which comprises twisting the spun yarn and the water-soluble yarn in a reverse direction to the twist direction of the spun yarn. This process may be a process for producing the composite twisted yarn fulfilling the above requirement (1), which comprises drawing (bundling and drawing) a spun yarn and a water-soluble yarn in parallel to one another (doubling a spun yarn and a water-soluble yarn), and twisting the spun yarn and the water-soluble yarn at (so as to have) a twist number of 1.3 to 3 times that of the twist number of the spun yarn. Moreover, this process may be a process for producing the composite twisted yarn fulfilling the above requirement (2), which comprises drawing (bundling and drawing) in parallel (doubling) a spun yarn, a water-soluble yarn, and an elongated elastic yarn, having an elongation of 2 to 5 times the original length of the elastic yarn, to one another, twisting the spun yarn, the water-soluble yarn, and the elastic yarn at (so as to have) a twist number of 0.3 to 3 times that of the twist number of the spun yarn.

Moreover, the present invention also embraces a process for producing a fabric (cloth), which comprises providing a textile formed from at least the above-mentioned composite twisted yarn, and dissolving the water-soluble yarn in the composite twisted yarn constituting the textile in a hydrophilic solvent to remove the water-soluble yarn therefrom. In this process, the hydrophilic solvent may comprise water, and the textile may contain not less than 10% by weight of the composite twisted yarn.

Further, the present invention also includes a fabric obtain able (or obtained) by the above process.

Effects of the Invention

According to the present invention, since (a) three species of yarns comprising a spun yarn, an elongated elastic yarn, and a water-soluble yarn are used in a specific proportion, (b) the three species of yarns are twisted in a reverse direction to the twist direction of the spun yarn, and (c) the ratio of the twist number of the twisted three species of yarns (the composite twisted yarn) relative to the twist number of the spun yarn is adjusted in a specific range; the composite twisted yarn has a high yarn strength, and has minimal fluff (fuzz). Further, exposure or protrusion of the elastic yarn outside the composite twisted yarn is inhibited. Furthermore, sorting a raw stock constituting the spun yarn is unnecessary; a variety of spun yarns are usable such as a spun yarn comprising a natural fiber (e.g., a cotton, a hemp, a silk, and a sheep wool) a spun yarn comprising a synthetic fiber, a spun yarn comprising a semisynthetic fiber, and a blended (mixed) spun yarn (or a union yarn) comprising a natural fiber and a synthetic fiber; and a composite twisted yarn having a desired yarn fineness from a fine count to a low count (coarse count) can be obtained. In addition, the composite twisted yarn is favorably usable in the manufacture of a wide variety of products in small quantities. Furthermore, since the above three species of yarns are used in a specific proportion, and these yarns are twisted in a reverse direction to the twist direction of the spun yarn (particularly, by twisting the three yarns in a reverse direction to the twist direction of the spun yarn and elongating the elastic yarn to 2 to 5 times its original length); a composite twisted yarn having excellent properties is smoothly producible with a high productivity.

Such a composite twisted yarn contains a water-soluble yarn and has minimal fluff (or fuzz). Further, the water-soluble yarn plays a role in reinforcement. Accordingly, even in knitting or weaving with a high-speed weaving or knitting machine, problems such as thread breakage do not occur. Furthermore, even in omitting warp sizing treatment, a textile is smoothly producible from such a composite twisted yarn with a high productivity.

In the case of dissolving and removing (dissolving and washing away) the water-soluble yarn from the textile obtained from such a composite twisted yarn, the place where the water-soluble yarn is removed forms voids (empty spaces) and a contractile (contractive) force generates in the composite twisted yarn so as to fill (bridge) the voids. Thereby a high stretching property and a strong repulsive force are given to the textile (fabric) made of the composite twisted yarn. Further, since the elastic yarn is favorably covered (entwined around) with the spun yarn, the textile (fabric) has an excellent external appearance, touch, air permeability, and is lightweight.

Moreover, in the present invention, since (a) a spun yarn and a water-soluble yarn are used in a specific proportion, (b) both yarns are twisted in a reverse direction to the twist direction of the spun yarn, and (c) the ratio of the twist number of the twisted yarn (the composite twisted yarn) relative to the twist number of the spun yarn is adjusted in a specific range; a variety of spun yarns are usable including not only a spun yarn comprising a sheep wool fiber, but also a spun yarn comprising a natural fiber, a spun yarn comprising a synthetic fiber, and a spun yarn comprising a semisynthetic fiber. Moreover, the composite twisted yarn is producible from any spun yarns having a fineness from a fine count to a low count. Further, since the composite twisted yarn free from an elastic yarn such as a polyurethane elastic yarn is producible, the deterioration (or damage) by heat or light over time due to use of the elastic yarn such as a polyurethane elastic yarn does not occur.

Moreover, since such a composite twisted yarn also contains a water-soluble yarn, the composite twisted yarn has minimal fluff (or fuzz), and even in employing a high-speed weaving or knitting machine, problems such as thread breakage do not occur. Further, even in omitting warp sizing treatment, a textile (fabric) is smoothly producible with a high productivity.

Further, in the case of dissolving and removing (washing away) the water-soluble yarn from the textile obtained from such a composite twisted yarn, since the length of the spun yarn is longer than that of the water-soluble yarn, a textile having a stretching property corresponding to the difference in length between these yarns is obtain able after the dissolving treatment. Further, the place where the water-soluble yarn is removed becomes a void, and a contractile strength increases in the composite twisted yarn so as to fill the void. Thereby, even without a polyurethane elastic yarn, a high stretching property is given to the textile (fabric). Further, this textile (fabric) has a puffiness (airy) and pleasant touch and feel, and excels in properties such as an external appearance and air permeability, and is lightweight.

Accordingly, by exploiting the above properties, the textile (fabric) of the present invention is effectively usable in wide-ranging fields such as a clothing application, a medical application, and an industrial material.

DETAILED DESCRIPTION OF THE INVENTION

Figure 1:
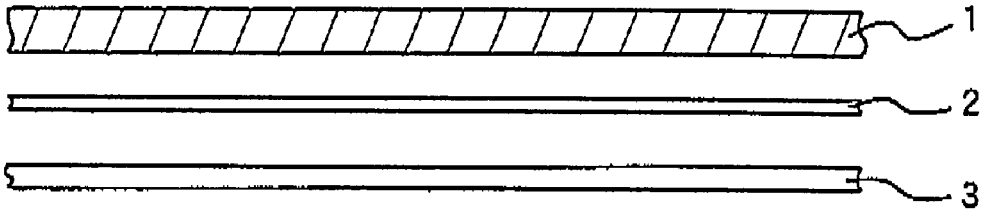
FIG. 1 is a view pattern diagram showing a circumstance in Example 4, in which the spun yarn, the polyurethane elastic yarn and the water-soluble yarn were drawn in parallel to one another with elongation of the polyurethane elastic yarn.

Hereinafter, the present invention is explained in detail.

[Composite Twisted Yarn]

The composite twisted yarn of the present invention at least comprises a spun yarn and a water-soluble yarn which is twisted with the spun yarn. The composite twisted yarn of the present invention may further comprise an elastic yarn in addition to the spun yarn and the water-soluble yarn, i.e., three species of yarns.

(Spun Yarn)

The spun yarn for the composite twisted yarn is not limited to a specific one. The spun yarn is made of a fiber which is insoluble in water (hot water), and may be any one of a synthetic fiber, a semisynthetic fiber, a regenerated fiber, or a natural fiber. The synthetic fiber may include, for example, a polyester-series fiber (e.g., an aromatic polyester fiber such as a polyethylene terephthalate fiber, a polytrimethylene terephthalate fiber, a polybutylene terephthalate fiber, or a polyethylene naphthalate fiber), a polyamide-series fiber (e.g., an aliphatic polyamide-series fiber such as a polyamide 6, a polyamide 66, a polyamide 11, a polyamide 12, a polyamide 610, or a polyamide 612; an alicyclic polyamide-series fiber; an aromatic polyamide-series fiber such as a polyphenyleneisophthalamide, a polyhexamethyleneterephthalamide, or a poly-p-phenyleneterephthalamide), a polyolefinic fiber (e.g., a poly$C_{2-4}$olefinic fiber such as a polyethylene, or a polypropylene), an acrylic fiber (e.g., an acrylonitrile-series fiber having an acrylonitrile unit, such as an acrylonitrile-vinyl chloride copolymer), a water (hot water)-insoluble polyvinyl alcohol-series fiber (e.g., an ethylene-vinyl alcohol-series copolymer fiber), a polyvinyl chloride-series fiber (e.g., a fiber made of a polyvinyl chloride, a vinyl chloride-vinyl acetate copolymer, or a vinyl chloride-acrylonitrile copolymer) a polyvinylidene chloride-series fiber (a fiber made of a vinylidene chloride-vinyl chloride copolymer or a vinylidene chloride-vinyl acetate copolymer), and others.

The semisynthetic fiber may include, for example, an acetate fiber such as a triacetate fiber. The regenerated fiber may include, for example, a rayon, a polynosic, a cupra, a lyocell (e.g., registered trade name: "Tencel"), and the like. As the natural fiber, cotton, wool (sheep wool), silk, hemp, and the like, for example, may be included. Further, an inorganic fiber such as a glass fiber, a carbon fiber or a metal fiber may be used.

These fibers may be used singly or in combination. In particular, the spun yarn is not limited to a single spun yarn comprising one selected (or obtained) from these fibers, and may be a blended spun yarn comprising two or more fibers. These fibers may be suitably selected depending on the application of the composite twisted yarn and the textile using the same. The generally used (multipurpose) fiber includes, for example, a synthetic fiber such as a polyamide-series fiber, a polyester-series fiber, or an acrylic fiber; a semisynthetic fiber such as an acetate fiber; a regenerated fiber such as a rayon, or a cupra; a natural fiber such as cotton, wool, or silk; and others. In particular, in the case of using an elastic yarn (e.g., a polyurethane elastic yarn) as an essential component, combination of the elastic yarn with a natural fiber such as cotton ensures the composite twisted yarn to have the feel or external appearance of a natural fiber.

The spun yarn may be any of a single yarn, a two ply (plied) yarn (double-twisted yarn), or a three or more ply (plied) yarn (triple-twisted yarn or more). In the present invention, "the twist number of the spun yarn" means the twist number (number of twists) of the final twist of the spun yarn upon producing. For example, in the case of the single yarn, the twist number thereof means the twist number of one yarn in spinning one yarn to produce the single yarn. In the case of the two ply yarn, the twist number thereof means the twist number of two yarns in twisting two yarns to produce the two ply yarn. In the case of the three or more ply yarn, the twist number thereof means the twist number of three or more yarns in twisting three or more yarns to produce the three or more ply yarn.

The twist number of the spun yarn is not particularly limited to a specific one. In the case where the twist number is represented by "T" (unit: time/2.54 cm), and the cotton count is represented by "S" (unit: yarn count number); the preferred spun yarn has a coefficient of twist "K" ($K=T/\sqrt{S}$) of about 1.5 to 5 (preferably about 2 to 4, and more preferably about 2.5 to 3.5) from the view point of the stability in quality of the spun yarn, the productivity for producing the composite twisted yarn, and the easy accessibility (availability) of the spun yarn.

In the case where the spun yarn is a two ply yarn or a three or more ply yarn, in view of the productivity of the ply yarn, the handling property of yarns, the feel, and the accessibility of the spun yarn, it is preferred that the final twist direction of these spun yarns is a reverse direction to the twisted direction of the single yarn used for producing the two ply or the three or more ply yarns. Further, it is preferred that the final twist number of the spun yarn (the twist number of the two ply yarn or three or more ply yarn) is about 0.3 (three-tenth) to 0.9 (nine-tenths) times (preferably about 0.4 (four-tenths) to 0.8 (eight-tenths) times) that of the twist number of the single yarn used for producing the two ply yarn or three or more ply yarn.

Moreover, as the yarn count number, it is preferred that the spun yarn has a cotton count number of about 5 to 200 (preferably about 7 to 150, and more preferably about 10 to 100) in terms of the smooth production of the composite twisted yarn, the easy accessibility of the spun yarn, and the requirements of the marketplace.

(Water-Soluble Yarn)

The water-soluble yarn is not particularly limited to a specific one, as long as the water-soluble yarn is soluble to a hydrophilic solvent. In particular, the preferred yarn includes a yarn that dissolves in water (hot water) under an atmospheric pressure at a temperature up to a boiling temperature of the water (about 100° C.). In the textile obtained from a composite twisted yarn containing such a water-soluble yarn, the water-soluble yarn can be easily removed by dissolving the water-soluble yarn in a hydrophilic solvent such as water. Thereby the textile is easily handled. In particular, the preferred water-soluble yarn includes a water-soluble yarn as follows: in the case where the water-soluble yarn itself (alone) is soaked in hot water at not lower than 80° C. (particularly not lower than 90° C.) and is left to stand for 30 minutes, not less than 85% by weight (particularly not less than 95% by weight) of the water-soluble yarn relative to the initial weight thereof (the weight before soaking) is soluble in the hot water. Thus, the preferred water-soluble yarn includes a water-soluble yarn having a water-insoluble residual of less than 15% by weight, particularly less than 5% by weight. In the case where the water solubility of the water-soluble yarn is low, even if the textile produced from the composite twisted yarn is treated with water, the water-soluble yarn in the composite twisted yarn cannot be sufficiently dissolved and removed. Accordingly, it is difficult to impart a sufficient stretching property to the textile or manufacture a light weight textile. Moreover, in the case of using the polyurethane elastic yarn, the covering of the polyurethane elastic yarn with the spun yarn is reduced.

The fiber constituting the water-soluble yarn is not particularly limited to a specific one as long as the fiber fulfils the above-mentioned water solubility requirement, and may include, for example, a fiber comprising (formed from) a water-soluble resin. The water-soluble resin may include, for example, a cellulose-series resin (e.g., a hydroxy$C_{1-3}$alkylcellulose such as a hydroxymethylcellulose), a polyvinyl-series resin (e.g., a polyvinylpyrrolidone, a polyvinyl ether, a polyvinyl alcohol, and a polyvinyl acetal), an acrylic copolymer or an alkali metal salt thereof (e.g., a copolymer containing a unit comprising an acrylic monomer such as a (meth) acrylic acid or a hydroxyl group-containing (meth)acrylate), a water-soluble polyamide-series resin (e.g., a polyamide having a polyoxyethylene unit, and a polyamide having a sulfonic acid group or hydroxyl group introduced therein), a water-soluble polyester-series resin (e.g., a polyester having a polyoxyethylene unit, or a polyester having a sulfonic acid group or amino group introduced therein), and others. These water-soluble resins may be used singly or in combination.

Among the water-soluble resins, the preferred one includes a polyvinyl-series resin. In particular, in view of fiber strength, high solubility to water (hot water), biodegrability, easy accessibility, and other properties, a water-soluble polyvinyl alcohol-series resin is preferred. In the water-soluble polyvinyl alcohol-series resin, since the thermal decomposition temperature is generally close to the melting or fusing temperature (the temperature at which the resin starts melting or fusing), melt spinning cannot be utilized. Therefore, in the present invention, a melt-spinnable water-soluble polyvinyl alcohol may be preferably used. For example, a polyvinyl alcohol-series resin having a reduced polymerization degree of about 200 to 800 (particularly about 250 to 500), and containing an olefin (particularly a $C_{2-10}\alpha$-olefin such as an ethylene) copolymerized in a proportion of about 3 to 20% by mol (particularly about 3 to 15% by mol) may be used. The fiber comprising a water-soluble polyvinyl alcohol-series resin is commercially available as, for example, a water-soluble vinylon.

The water-soluble yarn may be either a spun yarn or a filament yarn, as long as the yarn is soluble in water. From the viewpoint of easy dissolution and removal with the hydrophilic solvent, a filament yarn is preferred. In the case of using the filament yarn as the water-soluble yarn, use of the filament yarn enables smooth (or rapid) removal of the water-soluble yarn with a hydrophilic solvent such as water even in the textile obtained from a composite twisted yarn having a low mixed ratio (content) of the water-soluble yarn.

The yarn fineness of the water-soluble yarn is, for example, about 15 to 200 dtex, preferably about 20 to 150 dtex, and more preferably about 25 to 100 dtex. The water-soluble yarn having a yarn fineness of the above range realizes high productivity, and can be easily twisted with other yarn such as a spun yarn. Moreover, the yarn strength of the composite twisted yarn can be improved, and generation of fluff (or fuzz) in the spinning can be also decreased. Further, the water-soluble yarn can be easily removed by having the water-soluble yarn dissolved in the hydrophilic solvent, and the stretching property can be imparted to the textile after dissolving and removing the water-soluble yarn from the textile. Furthermore, in the case where the composite twisted yarn comprises the spun yarn and the polyurethane elastic yarn in combination, the covering property relative to the polyurethane elastic yarn can be improved.

In the present invention, the reason why a yarn soluble in a hydrophilic solvent such as water (water-soluble yarn) is employed as the yarn to be removed from the composite twisted yarn (a yarn to be removed from the textile made of the composite twisted yarn) instead of a yarn dissolving in or decomposing with an alkali or acid is as follows: in the case where part of the composite twisted yarn constituting the textile is removed with an alkali or acid, a spun yarn or polyurethane elastic yarn constituting the composite twisted yarn may be denatured or decomposed; and in the case where the textile is treated with a hydrophilic solvent such as water (particularly water), there is no possibility of denaturalization or decomposition of the spun yarn or the polyurethane elastic yarn. Use of such a water-soluble yarn allows a wide range of various spun yarns to be used as the spun yarn for the composite twisted yarn. That is, in the present invention, as long as a yarn is insoluble in a hydrophilic solvent such as water, even a yarn which is easy to dissolve in or decompose with an alkali or acid is usable as the spun yarn for the composite twisted yarn. Accordingly, the species or range for selecting the spun yarn constituting the composite twisted yarn is enlarged. Thereby in view of species, properties, or feel, a variety of textiles made of the composite twisted yarn can be obtained. In particular, in the case of using the fiber comprising a water-soluble polyvinyl alcohol-series resin as the water-soluble yarn, due to the high biodegrability of the fiber, the waste liquid containing the water-soluble yarn dissolved therein is decomposable with a microorganism and cleanable.

(Elastic Yarn)

The elastic yarn may be a yarn comprising a rubber component (e.g., a diene-series rubber, an acrylic rubber, an acrylic latex, an ethylene-$\alpha$-olefinic copolymer, an ethylene-$\alpha$-olefin-polyene copolymer, a urethane rubber, a silicone rubber, and a butyl rubber) or an elastomer (e.g., a styrenic thermoplastic elastomer, an olefinic thermoplastic elastomer, a polyester-series thermoplastic elastomer, a polyurethane-series thermoplastic elastomer, and a polyamide-series thermoplastic elastomer), and is preferably a polyurethane elastic yarn.

The polyurethane elastic yarn is referred to as so-called "Spandex (yarn)", and comprises an elastic polyurethane-series resin. As the elastic polyurethane-series resin, for example, there may be mentioned a urethane-series polymer obtained by a reaction of a polyol component with a polyisocyanate component.

As the polyol component, there may be preferably used a polyether polyol (e.g., a polyoxy$C_{2-4}$alkyleneglycol such as a polyethylene glycol or a polytetramethylene glycol ether), a polyester polyol (e.g., a polyesterdiol obtained by a reaction of a $C_{2-6}$ alkylene glycol such as butanediol with a $C_{4-12}$aliphatic dicarboxylic acid such as adipic acid), and the like. These polyol components may be used singly or in combination.

As the polyisocyanate, there may be preferably used an aliphatic polyisocyanate [e.g., an aliphatic diisocyanate such as hexamethylene diisocyanate (HDI), or trimethylhexamethylene diisocyanate (TMDI)], an alicyclic polyisocyanate [e.g., an alicyclic diisocyanate such as isophorone diisocyanate (IPDI), hydrogenated xylylene diisocyanate, or hydrogenated bis(isocyanatophenyl) methane], an aromatic polyisocyanate [e.g., tolylene diisocyanate (TDI), xylylene diisocyanate (XDI), and bis (isocyanatophenyl)methane (MDI)], and others. These polyisocyanates may be used singly or in combination.

As the polyurethane elastic yarn, there may be used a conventional polyurethane elastic yarn obtained by dry spinning, wet spinning or reaction spinning of these elastic polyurethane-series resins. The polyurethane elastic yarn may be a monofilament yarn, or a multifilament yarn. The yarn fineness of the polyurethane elastic yarn may be, for example, about 10 to 350 dtex, preferably about 15 to 200 dtex, and more preferably about 20 to 150 dtex. The polyurethane elastic yarn having a yarn fineness within the above range ensures that the spun yarn and the water-soluble yarn can be easily twisted, and that the covering property of the elastic yarn with the spun yarn in the textile after dissolving the water-soluble yarn is improved. Thereby a high stretching property can be imparted to the cloth.

(Composite Twisted Yarn in which Spun Yarn and Water-Soluble Yarn are Twisted Together)

In the composite twisted yarn of the present invention, in the case of twisting the spun yarn and the water-soluble yarn, the proportion (weight ratio) of the spun yarn relative to the water-soluble yarn ([spun yarn]/[water-soluble yarn]) is about 20/80 to 98/2, preferably about 30/70 to 95/5, and more preferably about 50/50 to 90/10. The composite twisted yarn having the proportion of these yarns in the above range excels in the ability to be weaved or knitted, yarn strength, and twisting stability. Further, the water-soluble yarn in the composite twisted yarn is soluble in the hydrophilic solvent and easily removed. Moreover, a contractile force for filling the void caused by removal of the water-soluble yarn effectively acts on the textile, and thereby a stretching property of the textile can be improved. In addition, the textile (fabric), after dissolving the water-soluble yarn from the textile made of the composite twisted yarn, has an improved feel, touch, and air permeability and is lightweight. In the case where the proportion of the water-soluble yarn is too small, the stretching property, air permeability and other properties of the textile are degraded, and the textile is not lightweight, and such a textile (fabric) is liable to have a hard (stiff) and impaired feel. On the contrary, in the case where the proportion of the water-soluble yarn is too large, the textile (fabric) after removing the water-soluble yarn deteriorates in morphological stability, and is liable to cause slippage.

In view of the limitation of the number of creels of the twisting machine and quality control of the composite twisted yarn, the number of spun yarns is 1 to 3 (preferably 1 to 2, and more preferably 1), and the number of water-soluble yarns is 1 to 3 (preferably 1 to 2, and more preferably 1). In usual cases, the composite twisted yarn is made of one spun yarn and one water-soluble yarn twisted with one another.

In such a composite twisted yarn, the twist direction of the composite twisted yarn (the twist direction upon twisting the spun yarn and the water-soluble yarn) (herein after, the twist of the composite twisted yarn is sometimes referred to as "second twist") is reverse to the twist direction of the spun yarn constituting the composite twisted yarn (herein after, the twist of the spun yarn constituting the composite twisted yarn is sometimes referred to as "first twist"), and the ratio (B/A) of the twist number "B" (unit: time/m) of the composite twisted yarn relative to the twist number "A" (unit: time/m) of the spun yarn is, for example, in a range of about 1.3 to 3 (i.e., the second twist number is about 1.3 to 3 times the first twist number), preferably about 1.4 to 3, and more preferably about 1.5 to 2.

Incidentally, in the present invention, "the twist number of the composite twisted yarn" (the second twist number) is defined as the twist number for twisting the spun yarn and the water-soluble yarn (or twisting the spun yarn, the water-soluble yarn, and the elastic yarn), and is practically a value in accordance with the twist number set in the twisting process.

From the viewpoint of lowering the torque (rotation moment) of the twist yarn, and improvement in feel, the second twist is conventionally made in a reverse direction to the twist direction of the first twist. However, in the conventional manner, the second twist number (or the number of second twists) is about 0.3 to 0.9 times (three-tenths to nine-tenths) the first twist number (or the number of first twists), that is, the second twist number is generally smaller than the first twist number. On the contrary, the composite twisted yarn of the present invention is greatly different from the conventional technique in which the second twist number is smaller than the first twist number, in the respect that the second twist number (the twist number of the composite twisted yarn: "A") has a specific range larger than the first twist number (the twist number of the spun yarn: "B").

In the composite twisted yarn, since the second twist number is about 1.3 to 3 times the first twist number, the second twist acts on the spun yarn as to untwist the twist of the spun yarn (first twist) while keeping morphological stability (twist stability) of the composite twisted yarn in the twisting step (in the second twisting) for producing the composite twisted yarn. Accordingly, upon the second twisting, the yarn length of the spun yarn becomes long, where as the yarn length of the water-soluble yarn becomes short because of twisting. Thereby, even if the untwisted (twist number of 0) spun yarn is further twisted, the composite twisted yarn is twistable while maintaining the relationship of yarn length between the spun yarn and the water-soluble yarn, that is, under the circumstances that the yarn length of the spun yarn is longer than that of the water-soluble yarn. As a result, the composite twisted yarn is fairly woven or knitted to give a textile, and by allowing the thus obtained textile to be soaked (immerse) with water for dissolving and removing (washing away) the water-soluble yarn, a fabric is obtained which has puffy (airy) feel due to an enlarged stretching property, an excellent air permeability, and is lightweight.

If the second twist number of the composite twisted yarn is less than 0.8 times (eight-tenths) the first twist number, untwisting of the spun yarn upon twisting for producing the composite twisted yarn is insufficient, and further the twist of the water-soluble yarn is also insufficient. Therefore, even if such a composite twisted yarn is used for producing the textile followed by removal of the water-soluble yarn from the textile by dissolving the water-soluble yarn in water, a fabric having a stretching property cannot be obtained. Moreover, in the case where the second twist number is not less than 0.8 times (eight-tenths) and less than 1.3 times the first twist number in the composite twisted yarn, although untwisting of the spun yarn upon producing the composite twisted yarn occurs, the twist of the composite twisted yarn itself becomes insufficient. Thereby the ability to weave or knit the composite twisted yarn is deteriorated, and a fabric having a morphological stability is unobtainable because of lack of twist of the spun yarn remaining after dissolving the water-soluble yarn in the hydrophilic solvent to remove the water-soluble yarn from the obtained textile. For example, in such a case, the fabric becomes a fabric from which the yarn is easy to slip out by pulling.

On the contrary, in the case where the second twist number is more than 3 times the first twist number, a problem such as thread breakage is liable to happen in the twisting step of the second twist (the twisting step for producing the composite twisted yarn). Thereby the productivity of the composite twisted yarn is decreased, and the yarn strength of the obtained composite twisted yarn is also deteriorated. Further, because of the excessively large torque of the composite twisted yarn, the productivity of the textile in weaving and knitting processes is also decreased.

The species of the twisting machine for twisting the spun yarn and the water-soluble yarn is not particularly limited to a specific one. There may be used, for example, a conventional or common twisting machine such as a double twister, a ring twister, or an up-twister.

(Composite Twisted Yarn in which Spun Yarn, Water-Soluble Yarn, and Elastic Yarn are Twisted Together)

In the case of twisting the spun yarn, the water-soluble yarn, and the elastic yarn, the proportion of each yarn can be suitably adjusted depending on the application of the composite twisted yarn or textile, the species of the spun yarn or water-soluble yarn, and others.

The proportion (weight ratio) of the spun yarn relative to the elastic yarn [spun yarn]/[elastic yarn] is, for example, about 50/50 to 99.9/0.1, preferably about 70/30 to 99.5/0.5, and more preferably about 80/20 to 99/1 (even more preferably about 90/10 to 97/3).

The proportion (weight ratio) of the total amount of the spun yarn and the elastic yarn relative to the water-soluble yarn [total amount of spun yarn and elastic yarn]/[water-soluble yarn] is, for example, about 30/70 to 99/1, preferably about 50/50 to 97/3, and more preferably about 60/40 to 95/5 (particularly about 70/30 to 90/10).

Moreover, with respect to the proportions of the spun yarn, the elastic yarn, and the water-soluble yarn, based on the weight of the composite twisted yarn, in general, the proportion of the spun yarn is about 20 to 98% by weight (preferably about 35 to 95% by weight), the proportion of the elastic yarn is about 0.5 to 20% by weight (preferably about 0.8 to 15% by weight), and the proportion of the water-soluble yarn is about 1 to 70% by weight (preferably 4 to 55% by weight).

In the case where each of the spun yarn, the elastic yarn and the water-soluble yarn has proportions in the above-mentioned ranges, exposure or protrusion of the elastic yarn outside the spun yarn is inhibited, and the composite twisted yarn can be easily used in weaving or knitting and an excellent yarn strength can be obtained. Further, the water-soluble yarn in the composite twisted yarn is soluble in the hydrophilic solvent and can be easily removed from the textile made of such a composite twisted yarn. In addition, because of the action of the contractile force in filling the void caused by removal of the water-soluble yarn on the textile, a stretching property and feel of the textile (fabric) is improved, and sufficient covering of the elastic yarn by the spun yarn is achieved.

In view of the limitation of the number of creels of the twisting machine and the quality control of the composite twisted yarn, the numbers of each yarn are such that the number of spun yarns is 1 to 3 (preferably 1 to 2), the number of elastic yarns is 1 to 2 (preferably 1), and the number of water-soluble yarns is 1 to 2 (preferably 1). The composite twisted yarn is usually made of one spun yarn, one elastic yarn, and one water-soluble yarn twisted together.

In such a composite twisted yarn, the twist direction (second twist) of the composite twisted yarn (the twist direction upon twisting the spun yarn, the elastic yarn, and the water-soluble yarn) is the reverse of the twist direction (first twist) of the spun yarn constituting the composite twisted yarn. In the case where the twist direction of the second twist is the reverse of the twist direction of the first twist, the twist (first twist) of the spun yarn is more or less untwisted by the second twist in the production process of the composite twisted yarn, thereby the yarn length of the spun yarn becomes a little longer than the original length. Then yarn-twisting is carried out under the circumstances where the untwisted spun yarn having a longer yarn length covers the elastic yarn or the water-soluble yarn. Thereby, after preparing the textile and dissolving the water-soluble yarn constituting the textile, the covering of the elastic yarn (e.g., a polyurethane elastic yarn) with the spun yarn is favorably conducted.

In the composite twisted yarn, the twist number of the composite twisted yarn (the second twist number) is about 0.3 (three-tenths) to 3 times, preferably about 0.5 (five-tenths) to 2.5 times, and more preferably about 0.8 (eight-tenths) to 2.5 times of the twist number of the spun yarn (the first twist number).

In the case where the first twist number is too large, the stability of the twist is degraded, the strength of the composite twisted yarn becomes widely varied, and prevention of the fluff is reduced. Moreover, because of a lack in the covering property of the elastic yarn and water-soluble yarn with the spun yarn, the weaving and knitting property of the composite twisted yarn is liable to be reduced. Further, in the twisting step for producing the composite twisted yarn, because of insufficient untwisting of the first twist, covering of the elastic yarn with the spun yarn is liable to be insufficient after preparing the textile and dissolving the water-soluble yarn therein.

On the contrary, in the case where the second twist number is too large, problems such as thread breakage occurs in the twisting step of the second twist, the productivity of the composite twisted yarn is decreased, thereby the strength of the thus obtained composite twisted yarn is also reduced. Further, the torque of the composite twisted yarn due to twisting becomes too high, and thus the productivity in the weaving or knitting process is also decreased.

Incidentally, in the composite twisted yarn containing the elastic yarn, "the twist number of the composite twisted yarn" (the second twist number) is defined as the twist number of twisting the spun yarn, the water-soluble yarn, and the elastic yarn, with elongating (stretching) the elastic yarn by a predetermined stretching force (power), and practically is a value in accordance with the twist number set in the process of twisting the composite yarn. That is, the second twist number is not the twist number of the composite twisted yarn in which the elastic yarn is no longer elongated (i.e., the elastic yarn is contracted to have an original length before elongation).

Such a composite twisted yarn is smoothly producible by twisting (second twisting) the three species of yarns, i.e., the spun yarn, elastic yarn and water-soluble yarn, in a reverse direction to the twist direction of the spun yarn (first twist) while elongating (stretching) the elastic yarn about 2 to 5 times, preferably about 2.5 to 4.5 times, and more preferably about 2.5 to 4 times relative to the original length. Here, the elongation ratio of the elastic yarn means an elongation ratio of the elongated (stretched) elastic yarn relative to the unelongated (unstretched) elastic yarn.

In the present invention, a twist of the composite twisted yarn (second twisting) which elongates the elastic yarn ensures that the textile obtained after dissolving and removing the water-soluble yarn therefrom will have a high stretching property, and an excellent kickback property (force of restitution, or resorting force). On the contrary, in the case where the stretching force of the elastic yarn upon the second twisting is too small, the stretching property of the composite twisted yarn as well as the textile becomes small. In the case where the stretching force of the elastic yarn is too large, the contractile force of the elastic yarn is too strong, resulting in repeated thread breakage during twisting. Accordingly, the composite twisted yarn is difficult to obtain, and even if the composite twisted yarn is obtained, productivity during weaving or knitting is decreased.

The species of the twisting machine used for twisting the spun yarn, elastic yarn and water-soluble yarn is also not particularly limited to a specific one. A conventional or common twisting machine, for example, a double twister, a ring twister, or an up-twister, may be used.

[Textile (Fabric) and Production Process Thereof]

The textile (fabric) of the present invention can be obtained from the composite twisted yarn, and the composite twisted yarn usually has a torque. Even if the composite twisted yarn has a torque, in the case where the torque does not adversely affect the weaving or knitting process, the composite twisted yarn as it is can be used for producing the textile without reducing the torque. On the contrary, in the case where the torque adversely affects the weaving or knitting process due to having the torque, it is preferred to reduce the torque by subjecting the composite twisted yarn to a heat (thermal) treatment. The heat treatment temperature for reducing the torque can be suitably selected depending on the species of the spun yarn, water-soluble yarn, or elastic yarn constituting the composite twisted yarn, or the torque strength of the composite twisted yarn, or others. In the present invention, the textile having a high stretching property is producible by using the above-mentioned composite twisted yarn.

The species or conformation of the textile (fabric) of the present invention is not particularly limited to a specific one. For example, the textile (fabric) may be a woven textile (fabric) (e.g., a plain weave fabric, a twill weave fabric, and a satin or sateen weave fabric), or a knitted textile (fabric) [e.g., a machine-knitting fabric, a crocheted fabric (a knitted fabric with a hooked needle), a knitted fabric with a stick needle (a hosiery fabric, or a looped fabric), an Afghan fabric, and a lace fabric], and others. Since the composite twisted yarn of the present invention also has a high yarn strength, even if the textile is produced with a weaving or knitting machine in a high (rapid) speed (e.g., weaving or knitting speed of not less than 0.05 m/minute), the production process of the textile does not bring about problems such as thread breakage, and is high in productivity.

The textile of the present invention is produced by using at least the composite twisted yarn, and the proportion of the composite twisted yarn to be used can be adjusted depending on the species or the use or purpose (e.g., degree of required stretching property) of the objective textile. The proportion of the composite twisted yarn relative to the total amount of the textile is, for example, not less than 10% by weight (e.g., about 10 to 100% by weight), preferably not less than 20% by weight (e.g., about 20 to 100% by weight), and more preferably not less than 25% by weight (e.g., about 25 to 100% by weight). Incidentally, as mentioned later, although the water-soluble yarn is extracted with the hydrophilic solvent and removed, the above-mentioned proportion of the composite twisted yarn in the textile is defined as the value including the weight of the water-soluble yarn. In the case where the proportion of the composite twisted yarn is too small, even if the water-soluble yarn is removed, the fabric having a high stretching property is hardly obtain able.

In the present invention, a fabric having a high stretching property is obtain able by extracting the water-soluble yarn from the composite twisted yarn with the hydrophilic solvent and removed from the textile obtained from the composite twisted yarn. As the hydrophilic solvent, there may be used, water, an alcohol (e.g., methanol, ethanol, isopropanol), a ketone (e.g., acetone), an ether (e.g., tetra hydrofuran), a cellosolve (e.g., methyl cellosolve, and ethyl cellosolve), a carbitol (e.g., carbitol, diethylene glycol dimethyl ether), and others. These hydrophilic solvents may be used singly or in combination. Among these hydrophilic solvents, water, a $C_{1-3}$alcohol such as ethanol, a ketone such as acetone, and a mixed solvent of water and other hydrophilic solvent(s) are preferred, and usually water is used.

The method for extracting (dissolving and removing) the water-soluble yarn is not particularly limited to a specific one. From the view point of efficient removal of the water-soluble yarn in a convenient way, the method may be soaking the textile in the hydrophilic solvent having a high temperature. In the case of using water as the hydrophilic solvent, the extract ant (the water used in extraction) may be neutral, or may be an alkali or acidic aqueous solution. Moreover, the extract ant may be an aqueous solution containing a surfactant added therein.

The extraction temperature can be adjusted depending on the species of the fiber constituting the water-soluble yarn, the solubility of the water-soluble yarn in the solvent, the configuration (morphology) or fineness of yarn, and others. For example, in the case where the water-soluble yarn comprising the water-soluble polyvinyl alcohol-series fiber is extracted with hot water, the extraction temperature is, for example, about 40 to 120° C., preferably about 50 to 110° C., and more preferably about 60 to 100° C. (even more preferably about 70 to 100° C.). The extraction at such a temperature ensures immediately removal of the water-soluble yarn from the textile in a short time. If the extraction temperature is too low, the extract ability of the water-soluble yarn is insufficient, and the productivity of the textile is decreased. Moreover, if the extraction temperature is too high, the dissolving time of the water-soluble yarn becomes too short and the quality of the textile is liable to be degraded.

The amount of the hydrophilic solvent is, based on weight, not less than 2 times the textile amount, and for example, about 2 to 1000 times, preferably about 3 to 100 times, more preferably about 5 to 50 times the textile amount. If the amount of the hydrophilic solvent is too small, removal of the water-soluble yarn becomes insufficient. Incidentally, in the case where the extraction and removal of the water-soluble yarn is insufficient, the water-soluble yarn may be repetitively extracted and removed in the hydrophilic solvent bath with the use of a fresh hydrophilic solvent without the water-soluble yarn.

The extraction time can be also suitably adjusted depending on the purpose, the machine to be used, or the extracting temperature. In considering the production efficiency, the production stability, and the quality or property of the obtained textile, the extraction time is, for example, about 1 to 300 minutes, preferably about 5 to 200 minutes, and more preferably about 10 to 100 minutes (even more preferably about 15 to 60 minutes).

The textile (fabric) after extracting the water-soluble yarn may be air dried. In terms of improving the feel or air permeability of the fabric, the textile is preferably dried with heating. The drying temperature can be suitably selected depending on the species of the fiber constituting the textile, and may be, for example, not lower than 60° C., preferably about 80 to 300° C., and more preferably about 100 to 200° C. (even more preferably about 120 to 160° C.). The drying time is, for example, about 0.5 minute to 24 hours, preferably about 1 minute to 10 hours, and more preferably about 3 minutes to 1 hour.

Incidentally, from the viewpoint of smooth production as well as the quality of the textile, treatment with such a hydrophilic solvent is preferably carried out prior to a step for dyeing (dying) the textile or adhering a resin to the textile. In the case where extraction of the water-soluble yarn is carried out during the dyeing step or the resin-adhering step, or after these steps, the extraction step adversely affects the dyeing step or resin-adhering step and is attributed to the insufficient removal of the water-soluble yarn.

The textile (fabric) of the present invention may contain, if necessary, an additive such as a stabilizer (e.g., a heat stabilizer, an ultra violet absorber, a light stabilizer, and an antioxidant), a fine particle, a coloring agent (colorant), an antistatic agent, a flame retardant, a plasticizer, a lubricant, or a retardant for retarding the speed of crystallinity. These additives may be used singly or in combination. These additives may be contained in any one of each yarn constituting the composite twisted yarn, the composite twisted yarn, and the textile.

INDUSTRIAL APPLICABILITY

Thus obtained fabric has a high stretching property as well as a plumpy and pleasant touch, and further excels in air permeability, and other properties and is lightweight. Therefore, by making use of such properties, the fabric (textile) is effectively utilized for, for example, a clothing material (e.g., a sport clothing material, an underwear, and a foundation garment), a medical material (e.g., an elastic band age), a material for a vehicle (e.g., a vehicle interior material), or an industrial material (e.g., a cloth for a belt conveyor).

EXAMPLES

Hereinafter, the following examples are intended to describe this invention in further detail and should by no means be interpreted as defining the scope of the invention. Incidentally, in Examples and Comparative Examples, the elongation (elongation rate) of a woven fabric (a plain weave fabric) was measured as follows.

[Elongation of Plain Weave Fabric]

(1) A test piece (a) and a test piece (b) were cut from a plain weave fabric prepared in the after-mentioned examples. The test piece (a) was a fabric of 15 cm (length) in the warp direction and 2.5 cm (width) in the weft direction, and the test piece (b) was a fabric of 2.5 cm (width) in the warp direction and 15 cm (length) in the weft direction.

(2) A weight (1 g) was attached on the central part of one edge (flange) of the longitudinal direction (the central of the width direction) of the test piece (a) cut in the above step (1), and the test piece was vertically hooked with keeping the edge attaching the weight in the downward direction, then the test piece was left to stand for one minute to measure the length ($La_1$) of the test piece (a) at that time.

Subsequently, the weight (1 g) was removed from the edge of the test piece (a), then a weight (300 g) was attached at the same place on the test piece, and the test piece was vertically hooked and left to stand for 3 minutes to measure the length ($La_2$) (cm) of the test piece at that time. The elongation (%) of the plain weave fabric in the warp direction was determined from the following mathematical formula (I).

$$\text{Elongation (\%) in the warp direction}=\{(La_2-La_1)/La_1\}\times 100 \quad \text{(i)}$$

(3) A weight (1 g) was attached on the central part of one edge (flange) in the longitudinal direction (the central part in the width direction) of the test piece (b) cut in the above step (1), and the test piece was vertically hooked, keeping the edge with the weight attached in the downward direction, then the test piece was left to stand for one minute to measure the length ($Lb_1$) of the test piece (b) at that time.

Subsequently, the weight (1 g) was removed from the edge of the test piece (b), then a weight (300 g) was attached at the same place on the test piece, and the test piece was vertically hooked and left to stand for 3 minutes to measure the length ($Lb_2$) (cm) of the test piece at that time. The elongation (%) of the plain weave fabric in the weft direction was determined from the following mathematical formula (II).

$$\text{Elongation (\%) in the weft direction}=\{(Lb_2-Lb_1)/Lb_1\}\times 100 \quad \text{(ii)}$$

Example 1

(1) (i) A spun yarn (twist number: 600 times/m (Z twist), cotton 100%, yarn count No. 20, manufactured by Tsuzuki Bouseki K. K., "TS 20 single yarn") was prepared. Incidentally, the spun yarn had a twist number "T" of 15.24 times per 2.54 cm (inch) and a yarn count number "S" of 20, thus the twist factor "K" found by the formula: $K=(T/\sqrt{S})$ was $15.24/\sqrt{20}=15.24/4.47=3.24$.

(ii) As the water-soluble yarn, a polyvinyl alcohol multifilament yarn (56 dtex) (a yarn dissolving in water at 80° C.) (manufactured by Kuraray Co., Ltd., "Water-soluble vinylon") was prepared.

(2) One piece of the spun yarn prepared in the above step (1) and one piece of the water-soluble yarn were supplied to a double twister (manufactured by Murata Machinery, Ltd., "36M"), and these yarns were twisted at (so as to have) a twist number (second twist) of 1000 times/m (S twist) to give a composite twisted yarn [the ratio of the twist number "B" of the composite twisted yarn relative to the twist number "A" of the spun yarn (B/A): about 1.67].

(3) A yarn having a predetermined length (1 m) was cut from the composite twisted yarn obtained in the step (2) to prepare a sample yarn, then the second twist of the sample yarn was untwisted to separate the spun yarn from the water-soluble yarn. Each of the separated yarns was weighed to determine the proportions of each yarn in the composite twisted yarn, and it was found that the composite twisted yarn comprised 84% by weight of the spun yarn and 16% by weight of the water-soluble yarn.

(4) The composite twisted yarn obtained in step (2) was used as a warp yarn and a weft yarn, and a plain weave fabric having 25 warp yarns/cm and 20 weft yarns/cm was woven (the mixing rate (composition) of the composite twisted yarn in the plain weave fabric=100% by weight). In the weaving step, the warp yarn was woven without sizing treatment. Nevertheless, the plain weave fabric could be produced by weaving without any problems such as thread breakage even at high speed (weaving speed: 0.1 m/minute) with excellent weaving productivity (weaving-mass productivity).

(5) The plain weave fabric obtained in step (4) was soaked in hot water at 80° C. for 30 minutes (bath ratio (ratio of the fabric relative to the water)=1:10), the water-soluble yarn in the composite twisted yarn constituting the fabric was dissolved and removed, then the fabric was taken out of the water (bath) and was dried at 150° C. for 2 minutes. In the thus obtained fabric, the elongations of the fabric in the warp direction and the weft direction were determined. The elongations in the warp direction and the weft direction were 20% and 22%, respectively, and the fabric had a high stretching property. Further, the fabric was plumpy as well as excellent in feel, and also excelled in air permeability and was lightweight.

Example 2

(1) A plain weave fabric having 25 warp yarns/cm and 20 weft yarns/cm was woven (mixing rate of the composite twist yarn in the plain weave fabric=40% by weight) by using a cotton two ply yarn (count No. 40) as the warp yarn and the composite twisted yarn obtained in the step (2) of Example 1 as the weft yarn. In the weaving step, the warp yarn was woven without sizing treatment. Nevertheless, the plain weave fabric could be produced by weaving without any problems such as thread breakage at high speed (weaving speed: 0.1 m/minute) and with excellent weaving productivity.

(2) The plain weave fabric obtained in step (1) was soaked in hot water at 80° C. for 30 minutes (bath ratio=1:10), the water-soluble yarn in the composite twisted yarn constituting the weft yarn of the fabric was dissolved and removed, then the fabric was taken out of the water (bath) and was dried at 150° C. for 2 minutes. In the thus obtained fabric, the elongations of the fabric in the warp direction and the weft direction were determined. The elongations in the warp direction and the weft direction were 11% and 23%, respectively, and the fabric had a high stretching property in the weft direction. Further, the fabric was plumpy as well as excellent in feel, and also excelled in air permeability and was lightweight.

Example 3

(1) (i) A spun yarn (twist number: 800 times/m (Z twist), cotton 100%, yarn count No. 40, manufactured by Tsuzuki Bouseki K. K., "TS 40 single yarn") was prepared, then two pieces of the spun yarn were supplied to a double twister (manufactured by Murata Machinery, Ltd., "36M") and twisted at a twist number (second twist) of 600 times/m (S twist) to give a two ply yarn.

(ii) As the water-soluble yarn, a polyvinyl alcohol multifilament yarn (56 dtex) (a yarn dissolving in water at 80° C.) (manufactured by Kuraray Co., Ltd., "Water-soluble vinylon") was prepared.

(2) One piece of the two ply yarn (spun yarn) prepared in the above step (1) and one piece of the water-soluble yarn were supplied to a double twister (manufactured by Murata Machinery, Ltd., "36M"), and these yarns were twisted at a twist number (second twist) of 1000 times/m (Z twist) to give a composite twisted yarn [the ratio of the twist number "B" of the composite twisted yarn relative to the twist number "A" of the spun yarn (B/A): about 1.67].

(3) A yarn having a predetermined length (1 m) was cut from the composite twisted yarn obtained in step (2) to prepare a sample yarn, then the second twist of the sample yarn was untwisted to separate the spun yarn (two ply yarn) from the water-soluble yarn. Each of the separated yarns was weighed to determine the proportions of each yarn in the composite twisted yarn, and it was found that the composite twisted yarn comprised 85% by mass of the spun yarn (two ply yarn) and 15% by weight of the water-soluble yarn.

(4) A plain weave fabric having 25 warp yarns/cm and 20 weft yarns/cm was woven (mixing rate of the composite twist yarn in the plain weave fabric=40% by weight) by using a cotton two ply yarn (count No. 40) as the warp yarn and the composite twisted yarn obtained in step (2) as the weft yarn. In the weaving step, the warp yarn was woven without sizing treatment. Nevertheless, the plain weave fabric could be produced by weaving without any problems such as thread breakage at high speed and with excellent weaving productivity (weaving speed: 0.1 m/minute).

(5) The plain weave fabric obtained in step (4) was soaked in hot water at 80° C. for 30 minutes (bath ratio=1:10), the water-soluble yarn in the composite twisted yarn constituting the fabric was dissolved and removed, then the fabric was taken out of the water (bath) and was dried at 150° C. for 2 minutes. In the thus obtained fabric, the elongations of the fabric in the warp direction and the weft direction were determined. The elongations in the warp direction and the weft direction were 10% and 21%, respectively, and the fabric had a high stretching property in the weft direction. Moreover, the fabric was plumpy as well as excellent in feel, and also excelled in air permeability and was lightweight.

Comparative Example 1

(1) One piece of spun yarn (twist number: 600 times/m (Z twist), cotton 100%, yarn count No. 20, manufactured by Tsuzuki Bouseki K. K., "TS 20 single yarn") and one piece of the water-soluble yarn comprising the polyvinyl alcohol multifilament yarn (56 dtex) used in Example 1 were supplied to a double twister (manufactured by Murata Machinery, Ltd., "36M"), and twisted at a twist number (second twist) of 400 times/m (S twist) to give a composite twisted yarn [the ratio of the twist number "B" of the composite twisted yarn relative to the twist number "A" of the spun yarn (B/A) about 0.67].

(2) A yarn having a predetermined length (1 m) was cut from the composite twisted yarn obtained in step (1) to prepare a sample yarn, then the second twist of the sample yarn was untwisted to separate the spun yarn from the water-soluble yarn. Each of the separated yarns was weighed to determine the proportions of each yarn in the composite twisted yarn, and it was found that the composite twisted yarn comprised 84% by mass of the spun yarn and 16% by mass of the water-soluble yarn.

(3) A plain weave fabric having 25 warp yarns/cm and 20 weft yarns/cm was woven (mixing rate of the composite twist yarn in the plain weave fabric=40% by weight) by using a cotton two ply yarn (count No. 40) as the warp yarn and the composite twisted yarn obtained in the step (1) as the weft yarn (weaving speed: 0.1 m/minute).

(4) The plain weave fabric obtained in step (3) was soaked in hot water at 80° C. for 30 minutes (bath ratio=1:10), the water-soluble yarn in the composite twisted yarn constituting the fabric was dissolved and removed, then the fabric was taken out of the water (bath) and was dried at 150° C. In the thus obtained fabric, the elongations of the fabric in the warp direction and the weft direction were determined. The elongations in the warp direction and the weft direction were 11% and 12%, respectively, and the fabric had a low stretching property.

Comparative Example 2

One piece of spun yarn (twist number: 600 times/m (Z twist), cotton 100%, yarn count No. 20, manufactured by Tsuzuki Bouseki K. K., "TS 20 single yarn") and one piece of the water-soluble yarn comprising the polyvinyl alcohol multifilament yarn (56 dtex) used in Example 1 were supplied to a double twister (manufactured by Murata Machinery, Ltd., "36M"), and twisted at a twist number (second twist) of 700 times/m (S twist) to give a composite twisted yarn [the ratio of the twist number "B" of the composite twisted yarn relative to the twist number "A" of the spun yarn (B/A) about 1.17].

(2) A yarn having a predetermined length (1 m) was cut from the composite twisted yarn obtained in step (1) to prepare a sample yarn, then the second twist of the sample yarn was untwisted to separate the spun yarn from the water-soluble yarn. Each of the separated yarns was weighed to determine the proportions of each yarn in the composite twisted yarn, and it was found that the composite twisted yarn comprised 84% by mass of the spun yarn and 16% by weight of the water-soluble yarn.

(3) A plain weave fabric having 25 warp yarns/cm and 20 weft yarns/cm was woven (mixing rate of the composite twist yarn in the plain weave fabric=40% by weight) by using a cotton two ply yarn (count No. 40) as the warp yarn and the composite twisted yarn obtained in step (1) of Example 1 as the weft yarn (weaving speed: 0.1 m/minute).

(4) The plain weave fabric obtained in step (3) was soaked in hot water at 80° C. for 30 minutes (bath ratio=1:10), the water-soluble yarn in the composite twisted yarn constituting the fabric was dissolved and removed, then the fabric was taken out of the water (bath) and was dried at 15° C. for 2 minutes. Pulling out the thus obtained fabric in the weft direction revealed that the yarn was easy to slip out without any resistance, and that the fabric had no practical use.

Comparative Example 3

One piece of spun yarn (twist number: 600 times/m (Z twist), cotton 100%, yarn count No. 20, manufactured by Tsuzuki Bouseki K. K., "TS 20 single yarn") and one piece of the water-soluble yarn comprising the polyvinyl alcohol multifilament yarn (56 dtex) used in Example 1 were supplied to a double twister (manufactured by Murata Machinery, Ltd., "36M"), and twisted at a twist number (second twist) of 3500 times/m (S twist) to give a composite twisted yarn [the ratio of the twist number "B" of the composite twisted yarn relative to the twist number "A" of the spun yarn (B/A): about 5.93]. However, the composite twisted yarn could not be produced because of hard twisting due to too many thread breakages.

Comparative Example 4

(1) (i) A spun yarn (twist number: 350 times/m (Z twist), cotton 100%, yarn count No. 10, manufactured by Tsuzuki Bouseki K. K., "TS 10 single yarn") was prepared, then two pieces of the spun yarns were supplied to a double twister (manufactured by Murata Machinery, Ltd., "36M") and twisted at a twist number (second twist) of 300 times/m (S twist) to give a two ply yarn.

(ii) As the water-soluble yarn, the polyvinyl alcohol multifilament yarn (56 dtex) used in Example 1 was prepared.

(2) One piece of the two ply yarn (spun yarn) prepared in the above step (1) and one piece of the water-soluble yarn were supplied to a double twister (manufactured by Murata Machinery, Ltd., "36M"), and these yarns were twisted at a twist number (second twist) of 600 times/m (Z twist) to give a composite twisted yarn [the ratio of the twist number "B" of the composite twisted yarn relative to the twist number "A" of the spun yarn (B/A): 2].

(3) A yarn having a predetermined length (1 m) was cut from the composite twisted yarn obtained in step (2) to prepare a sample yarn, then the second twist of the sample yarn was untwisted to separate the spun yarn (two ply yarn) from the water-soluble yarn. Each of the separated yarns was weighed to determine the proportions of each yarn in the composite twisted yarn, and it was found that the composite twisted yarn comprised 98.2% by weight of the spun yarn (two ply yarn) and 1.8% by weight of the water-soluble yarn.

(4) A plain weave fabric having 25 warp yarns/cm and 13 weft yarns/cm was woven (mixing rate of the composite twist yarn in the plain weave fabric=50% by weight) by using a cotton two ply yarn (count No. 40) as the warp yarn and the composite twisted yarn obtained in step (2) as the weft yarn.

(5) The plain weave fabric obtained in step (4) was soaked in hot water at 80° C. for 30 minutes (bath ratio=1:10), the water-soluble yarn in the composite twisted yarn constituting the fabric was dissolved and removed, then the fabric was taken out of the water (bath) and was dried at 150° C. for 2 minutes. In the thus obtained fabric, the elongations of the fabric in the warp direction and the weft direction were determined. The elongations in the warp direction and the weft direction were 10% and 13%, respectively, and the fabric was low in stretching property.

Comparative Example 5

(1) (i) A spun yarn (twist number: 1500 times/m (Z twist), cotton 100%, yarn count No. 120, manufactured by Royal Textile Mills Ltd., "Royal 120" made in India) was prepared.

(ii) As the water-soluble yarn, a polyvinyl alcohol multifilament yarn (330 dtex) (a yarn dissolving in water at 80° C.) (manufactured by Kuraray Co., Ltd., "Water-soluble vinylon") was prepared.

(2) One piece of the spun yarn prepared in the above step (1) and one piece of the water-soluble yarn were supplied to a double twister (manufactured by Murata Machinery, Ltd., "36M"), and these yarns were twisted at a twist number (second twist) of 2500 times/m (S twist) to give a composite twisted yarn [the ratio of the twist number "B" of the composite twisted yarn relative to the twist number "A" of the spun yarn (B/A): about 1.67].

(3) A yarn having a predetermined length (1 m) was cut from the composite twisted yarn obtained in step (2) to prepare a sample yarn, then the second twist of the sample yarn was untwisted to separate the spun yarn from the water-soluble yarn. Each of the separated yarns was weighed to determine the proportions of each yarn in the composite twisted yarn, and it was found that the composite twisted yarn comprised 13% by weight of the spun yarn and 87% by weight of the water-soluble yarn.

(4) A plain weave fabric having 25 warp yarns/cm and 20 weft yarns/cm was woven (mixing rate of the composite twist yarn in the plain weave fabric=40% by weight) (weaving speed: 0.1 m/minute) by using a cotton two ply yarn (count No. 40) as the warp yarn and the composite twisted yarn obtained in step (2) as the weft yarn.

(5) The plain weave fabric obtained in step (4) was soaked in hot water at 80° C. for 30 minutes (bath ratio=1:10), the water-soluble yarn in the composite twisted yarn constituting the fabric was dissolved and removed, then the fabric was taken out of the water (bath) and was dried at 150° C. for 2 minutes. The thus obtained fabric was deteriorated in morphological stability and was liable to cause slippage. Accordingly the fabric was of less practical use.

Comparative Example 6

(1) A plain weave fabric having 25 warp yarns/cm and 13 weft yarns/cm was woven (mixing rate of the composite twist yarn in the plain weave fabric=8% by weight). As the warp yarn, one piece of cotton two ply yarn (count No. 40) was used. As the weft yarn, one piece of the composite twisted yarn obtained in step (2) of Example 1 and four pieces of cotton two ply yarn (count No. 30) were used.

(2) The plain weave fabric obtained in step (1) was soaked in hot water at 80° C. for 30 minutes (bath ratio=1:10), the water-soluble yarn in the composite twisted yarn constituting the fabric was dissolved and removed, then the fabric was taken out of the water (bath) and was dried at 150° C. for 2 minutes. In the thus obtained fabric, the elongations of the fabric in the warp direction and the weft direction were determined. The elongations in the warp direction and the weft direction were 11% and 10%, respectively, and the fabric had a low stretching property.

Example 4

(1) (i) A spun yarn (twist number: 600 times/m (Z twist), cotton 100%, yarn count No. 20, manufactured by Tsuzuki Bouseki K. K., "TS 20 single yarn") was prepared.

(ii) A multifilament yarn (manufactured by Opelontex Co., Ltd., "Lycra 127C") comprising an elastic polyurethane having a fineness of single fiber of 78 dtex was prepared as the polyurethane elastic yarn.

(iii) As the water-soluble yarn, the polyvinyl alcohol multifilament yarn (56 dtex) used in Example 1 (a yarn completely dissolving in water at 90° C.) (manufactured by Kuraray Co., Ltd., "Water-soluble vinylon") was prepared.

(2) As shown in the pattern diagram of FIG. 1, one piece of the spun yarn "1" prepared in step (1), one piece of the polyurethane elastic yarn "2", and one piece of the water-soluble yarn "3" were drawn almost in parallel to one another with elongation of the polyurethane elastic yarn to 3.5 times its original length, then these yarns were entwined in a cheese-like shape to prepare a cheese.

Figure 2:
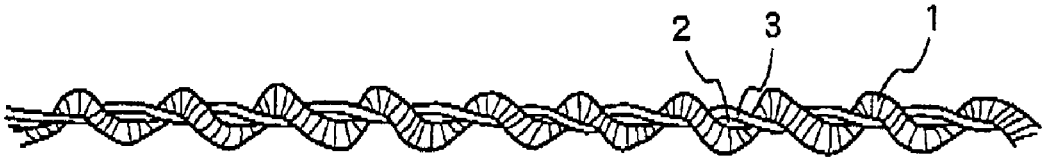
FIG. 2 is view pattern diagram showing a configuration of the composite twisted yarn obtained in Example 4 (3).

(3) With entwining back (unentwining) the three species of yarns from the cheese obtained in step (2) and elongating the polyurethane elastic yarn into the above-mentioned 3.5 times the original length, these yarns were twisted (second twist) with a double twister (manufactured by Murata Machinery, Ltd., "36M") at a twist number of the composite twisted yarn of 1200 times/m (S twist). Thus, a composite twisted yarn (fineness: 369 dtex) having a pattern diagram shown in FIG. 2 was prepared. As shown in FIG. 2, in the thus obtained composite twisted yarn, the polyurethane elastic yarn "2" and the water-soluble yarn "3" were covered with the spun yarn "1", and there were no problems with the polyurethane elastic yarn "2" protruding outside the spun yarn "1".

(4) A yarn having a predetermined length (1 m) was cut from the composite twisted yarn obtained in step (3) to prepare a sample yarn, then the second twist of the sample yarn was untwisted to separate into three yarns, i.e., the spun yarn, the polyurethane elastic yarn, and the water-soluble yarn. Each of the separated yarns was weighed to determine the proportions of each yarn in the composite twisted yarn, and it was found that the composite twisted yarn comprised 79.1% by weight of the spun yarn, 6% by weight of the polyurethane elastic yarn, and 14.9% by weight of the water-soluble yarn.

(5) The composite twisted yarn obtained in step (3) was used as a warp yarn and a weft yarn, and a plain weave fabric having 25 warp yarns/cm and 20 weft yarns/cm was woven (mixing rate of the composite twisted yarn in the plain weave fabric=100% by weight). In the weaving step, the warp yarn was woven without sizing treatment. Nevertheless, the plain weave fabric could be produced by weaving without any problems such as thread breakage at high speed (weaving speed: 0.1 m/minute) and with excellent weaving productivity.

(6) The plain weave fabric obtained in step (5) was soaked in hot water at 90° C. for 30 minutes (bath ratio=1:10), the water-soluble yarn in the composite twisted yarn constituting the fabric was dissolved and removed, then the fabric was taken out of the water (bath) and was dried at 150° C. for 2 minutes. In the thus obtained fabric, the elongations of the fabric in the warp direction and the weft direction were determined. The elongations in the warp direction and the weft direction were 23% and 27%, respectively, and the fabric had a high stretching property, and also excelled in repulsive properties. Further, the fabric was plumpy due to removal of the water-soluble yarn by dissolution with water, and also was lightweight.

Figure 3:
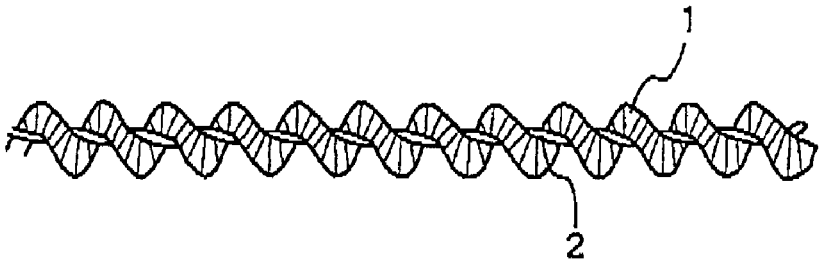
FIG. 3 is view pattern diagram showing a configuration of the composite twisted yarn constituting a textile obtained in Example 4 (6), in which the textile is treated with hot water.

Moreover, observation of the structure of the warp yarn and the weft yarn constituting the fabric after hot water treatment revealed that the polyurethane elastic yarn "2" was favorably covered with the cotton spun yarn "1" as shown in the pattern diagram of FIG. 3, and such a structure contributed to the excellent feel of the fabric.

Example 5

(1) A plain weave fabric having 25 warp yarns/cm and 20 weft yarns/cm was woven (mixing rate of the composite twist yarn in the plain weave fabric=40% by weight) by using a cotton two ply yarn (count No. 40) as the warp yarn and the composite twisted yarn obtained in step (6) of Example 4 as the weft yarn. In the weaving step, the warp yarn was woven without sizing treatment. Nevertheless, the plain weave fabric could be produced by weaving without any problems such as thread breakage at high speed (weaving speed: 0.1 m/minute) and with excellent weaving productivity.

(2) The plain weave fabric obtained in step (1) was soaked in hot water at 90° C. for 30 minutes (bath ratio=1:10), the water-soluble yarn in the composite twisted yarn constituting the weft yarn of the fabric was dissolved and removed, then the fabric was taken out of the water (bath) and was dried at 150° C. for 2 minutes. In the thus obtained fabric, the elongations of the fabric in the warp direction and the weft direction were determined. The elongations in the warp direction and the weft direction were 8% and 28%, respectively, and the fabric had a high stretching property in the weft direction, and also excelled in repulsive properties. Further, the fabric was plumpy due to removal of the water-soluble yarn by water dissolution, and also was lightweight. Furthermore, as shown in the pattern diagram of FIG. 3, in the weft yarn constituting the fabric after treatment with water (hot water), the polyurethane elastic yarn was favorably covered with the cotton spun yarn, thereby the fabric had an excellent feel.

Comparative Example 7

(1) One piece of the spun yarn (Z twist, twist number 600 times/m) and one piece of the polyurethane elastic yarn both used in Example 4 were drawn almost in parallel to one another, then these yarns were entwined in the cheese-like shape to prepare a cheese.

(2) With entwining back the two species of yarns from the cheese obtained in step (1) as well as elongating the polyurethane elastic yarn to the above-mentioned 3.5 times its original length, these yarns were twisted (second twist) with the same double twister (manufactured by Murata Machinery, Ltd., "36M") as that used in Example 4 at a twist number of the composite twisted yarn of 1200 times/m (S twist). Then, a composite twisted yarn (fineness: 314 dtex) was given.

(3) A plain weave fabric having 25 warp yarns/cm and 20 weft yarns/cm was woven (mixing rate of the composite twist yarn in the plain weave fabric=40% by weight) by using a cotton two ply yarn (count No. 40) as the warp yarn and the composite twisted yarn obtained in step (2) as the weft yarn. In the thus obtained fabric, the elongations of the fabric in the warp direction and the weft direction were determined. The elongations in the warp direction and the weft direction were 8% and 13%, respectively, and the fabric had an inferior stretching property compared with the fabrics obtained in Examples 4 and 5 after removing the water-soluble yarn by hot-water dissolution. Moreover, the fabric was not as plumpy or as lightweight.

Comparative Example 8

(1) one piece of the spun yarn (Z twist, twist number: 600 times/m) used in Example 4, one piece of the polyurethane elastic yarn used in Example 4, and one piece of the water-soluble yarn used in Example 4 were drawn almost in parallel to one another with elongation of the polyurethane elastic yarn to 3.5 times its original length, then these yarns were entwined in the cheese-like shape to prepare a cheese.

(2) With entwining back the three species of yarns from the cheese obtained in step (1) as well as elongating the polyurethane elastic yarn into the above-mentioned 3.5 times the original length, these yarns were twisted (second twist) with the same double twister as that used in Example 4 at a twist number of the composite twisted yarn of 150 times/m (S twist). Thereafter, the tensile force on the polyurethane elastic yarn was released to obtain a composite twisted yarn.

(3) A plain weave fabric having 25 warp yarns/cm and 20 weft yarns/cm was woven (mixing rate of the composite twist yarn in the plain weave fabric=40% by weight) by using a cotton two ply yarn (count No. 40) as the warp yarn and the composite twisted yarn obtained in step (2) as the weft yarn. In the weaving procedure, since the twist number of the composite twisted yarn (the second twist number) was 0.25 time (twenty five-hundredths) of the twist number of the spun yarn (the first twist number), the covering of the polyurethane elastic yarn and others with the spun yarn was insufficient in the composite twisted yarn (weft yarn). Therefore, the composite twisted yarn had a lot of parts where the polyurethane elastic yarn was outwardly exposed. Moreover, due to lack in fluff prevention (inhibition) and further uneven yarn strength, thread breakage occurred frequently in the weaving procedure. Accordingly, the weaving productivity of the fabric was deteriorated.

(4) The plain weave fabric obtained in step (3) was soaked in hot water at 90° C. for 30 minutes (bath ratio=1:10), the water-soluble yarn in the composite twisted yarn constituting the weft yarn of the fabric was dissolved and removed, then the fabric was taken out of the water (bath) and was dried at 150° C. In the thus obtained fabric, the elongations of the fabric in the warp direction and the weft direction were determined. The elongations in the warp direction and the weft direction were 8% and 23%, respectively, and the fabric had a high stretching property in the weft direction. However, because of insufficient covering of the polyurethane elastic yarn with the spun yarn, the fabric had many parts where the polyurethane elastic yarn was exposed, and had less commercial value.

Comparative Example 9

(1) One piece of the spun yarn (Z twist, twist number: 600 times/m) used in Example 4, one piece of the polyurethane elastic yarn used in Example 4, and one piece of the water-soluble yarn used in Example 1 were drawn almost in parallel to one another with elongation of the polyurethane elastic yarn to 5.5 times its original length, then these yarns were entwined in the cheese-like shape to prepare a cheese.

(2) With entwining back the three species of yarns from the cheese obtained in step (1) as well as elongating the polyurethane elastic yarn into the above-mentioned 5.5 times the original length, these yarns were twisted (second twist) with the double twister used in Example 4 at a twist number of the composite twisted yarn of 1200 times/m (S twist) to produce a composite twisted yarn. However, due to a too strong contractile force by the polyurethane elastic yarn, the twisting procedure did not work well, and the composite twisted yarn was not able to be produced.

Comparative Example 10

(1) one piece of the spun yarn (Z twist, twist number: 600 times/m) used in Example 4, one piece of the polyurethane elastic yarn used in Example 4, and one piece of the water-soluble yarn used in Example 4 were drawn almost in parallel to one another with elongation of the polyurethane elastic yarn to 3.5 times its original length, then these yarns were entwined in the cheese-like shape to prepare a cheese.

(2) With entwining back the three species of yarns from the cheese obtained in step (1) as well as elongating the polyurethane elastic yarn to the above-mentioned 3.5 times the original length, these yarns were twisted (second twist) with the same double twister as the one used in Example 1 at a twist number of the composite twisted yarn of 2100 times/m (S twist) for producing the composite twisted yarn. However, due to a too strong torque of the yarns, the yarns were liable to entwine with the twisting machine. Further, thread breakages frequently occurred because the yarns could not resist against the torque, thereby the composite twisted yarn was not able to be produced.

Comparative Example 11

(1) one piece of the spun yarn (Z twist, twist number: 600 times/m) used in Example 4, one piece of the polyurethane elastic yarn used in Example 4, and one piece of the water-soluble yarn used in Example 4 were drawn almost in parallel to one another to elongate the polyurethane elastic yarn to 1.5 times its original length, then these yarns were entwined in the cheese-like shape to prepare a cheese.

(2) With unentwining (entwining back) the three species of yarns from the cheese obtained in step (1) as well as elongating the polyurethane elastic yarn to the above-mentioned 1.5 times the original length, these yarns were twisted (second twist) with the same double twister as the one used in Example 1 at a twist number of the composite twisted yarn of 1200 times/m (S twist). Thereafter, the tensile force on the polyurethane elastic yarn was released to obtain a composite twisted yarn.

(3) A plain weave fabric having 25 warp yarns/cm and 20 weft yarns/cm was woven (mixing rate of the composite twist yarn in the plain weave fabric=40% by weight) by using a cotton two ply yarn (count No. 40) as the warp yarn and the composite twisted yarn obtained in the step (2) as the weft yarn.

(4) The plain weave fabric obtained in step (3) was soaked in hot water at 90° C. for 30 minutes (bath ratio=1:10), the water-soluble yarn in the composite twisted yarn constituting the weft yarn of the fabric was dissolved and removed, then the fabric was taken out of the water (bath) and was dried at 150° C. In the thus obtained fabric, the elongations of the fabric in the warp direction and the weft direction were determined. The elongations in the warp direction and the weft direction were 8% and 9%, respectively.

Comparative Example 12

(1) A plain weave fabric having 25 warp yarns/cm and 20 weft yarns/cm was woven (mixing rate of the composite twist yarn in the plain weave fabric=8% by weight). As the warp yarn, one piece of cotton two ply yarn (count No. 40) was used. As the weft yarn, the composite twisted yarn obtained in step (3) of Example 4 and a cotton two ply yarn (count No. 20) were used in the proportion (yarn length ratio) of one piece of composite twisted yarn relative to three pieces of cotton two ply yarns.

(2) The plain weave fabric obtained in step (1) was soaked in hot water at 90° C. for 30 minutes (bath ratio=1:10), the water-soluble yarn in the composite twisted yarn constituting part of the weft yarn of the fabric was dissolved and removed, then the fabric was taken out of the water (bath) and was dried at 150° C. In the thus obtained fabric, the elongations of the fabric in the warp direction and the weft direction were determined. The elongations in the warp direction and the weft direction were 8% and 10%, respectively.

The invention claimed is:

1. A textile, comprising:

not less than 20% by weight of a composite twisted yarn, comprising:

a spun yarn having a twist direction that is a reverse of a twist direction of the composite twisted yarn; and a water-soluble yarn which is twisted with the spun yarn, wherein a twist number of the composite twisted yarn is 1.3 to 3 times a twist number of the spun yarn, and a weight ratio of the spun yarn relative to the water-soluble yarn [spun yarn]/[water-soluble yarn] is 20/80 to 98/2.

2. A textile according to claim 1, wherein the water-soluble yarn is a water-soluble filament yarn.

3. A textile, comprising:

not less than 20% by weight of a composite twisted yarn, comprising:

a spun yarn having a twist direction that is a reverse of a twist direction of the composite twisted yarn;

a water-soluble yarn which is twisted with the spun yarn; and an elongated elastic yarn which has an elongation of 2 to 5 times an original length of the elastic yarn in a non-elongated position, and the elongated elastic yarn is twisted with the water-soluble yarn and the spun yarn, wherein a twist number of the composite twisted yarn is 0.3 to 3 times a twist number of the spun yarn, a weight ratio of the spun yarn to the elastic yarn [spun yarn]/[elastic yarn] is 50/50 to 99.9/0.1, and a weight ratio of a total amount of the spun yarn and the elastic yarn to the water-soluble yarn [total amount of the spun yarn and the elastic yarn]/[water-soluble yarn] is 30/70 to 99/1.

4. A textile according to claim 3, wherein the elastic yarn is a polyurethane elastic yarn.

5. A textile according to claim 3, wherein, based on a weight of the composite twisted yarn, a proportion of the spun yarn is 20 to 98% by weight, a proportion of the elastic yarn is 0.5 to 20% by weight, and a proportion of the water-soluble yarn is 1 to 70% by weight.

6. A textile according to claim 3, wherein the water-soluble yarn is a water-soluble filament yarn.

7. A process for producing a fabric, comprising:

providing a textile including not less than 20% by weight of a composite twisted yarn, the textile including a spun yarn having a twist direction that is a reverse of a twist direction of the composite twisted yarn; and a water-soluble yarn which is twisted with the spun yarn, wherein a twist number of the composite twisted yarn is 1.3 to 3 times a twist number of the spun yarn, and a weight ratio of the spun yarn relative to the water-soluble yarn [spun yarn]/[water-soluble yarn] is 20/80 to 98/2; and dissolving the water-soluble yarn in the composite twisted yarn constituting the textile in a hydrophilic solvent to remove the water-soluble yarn.

8. A process according to claim 7, wherein the hydrophilic solvent comprises water.

9. A process for producing a fabric, comprising:

providing a textile including not less than 20% by weight of a composite twisted yarn, including a spun yarn having a twist direction that is a reverse of a twist direction of the composite twisted yarn;

a water-soluble yarn which is twisted with the spun yarn; and an elongated elastic yarn which has an elongation of 2 to 5 times an original length of the elastic yarn in a non-elongated position, and the elongated elastic yarn is twisted with the water-soluble yarn and the spun yarn, wherein a twist number of the composite twisted yarn is 0.3 to 3 times a twist number of the spun yarn, a weight ratio of the spun yarn to the elastic yarn [spun yarn]/[elastic yarn] is 50/50 to 99.9/0.1, and a weight ratio of a total amount of the spun yarn and the elastic yarn to the water-soluble yarn [total amount of the spun yarn and the elastic yarn]/[water-soluble yarn] is 30/70 to 99/1; and dissolving the water-soluble yarn in the composite twisted yarn constituting the textile in a hydrophilic solvent to remove the water-soluble yarn.

10. A process according to claim 9, wherein the hydrophilic solvent comprises water.

* * * * *